US009436148B2

(12) United States Patent
Maeda

(10) Patent No.: US 9,436,148 B2
(45) Date of Patent: Sep. 6, 2016

(54) IMAGE FORMING APPARATUS AND IMAGE FORMING METHOD

(71) Applicant: Katsuhiko Maeda, Kanagawa (JP)

(72) Inventor: Katsuhiko Maeda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/698,648

(22) Filed: Apr. 28, 2015

(65) Prior Publication Data

US 2015/0316870 A1 Nov. 5, 2015

(30) Foreign Application Priority Data

May 1, 2014 (JP) ..... 2014-094762
Jun. 2, 2014 (JP) ..... 2014-113873

(51) Int. Cl.
*G03G 15/30* (2006.01)
*G03G 15/00* (2006.01)
*G03G 15/043* (2006.01)

(52) U.S. Cl.
CPC ..... *G03G 15/6564* (2013.01); *G03G 15/043* (2013.01); *G03G 2215/00409* (2013.01); *G03G 2215/00599* (2013.01)

(58) Field of Classification Search
CPC ..... G03G 15/6558; G03G 15/6561; G03G 15/6564; G03G 2215/00409; G03G 2215/00599
USPC ..... 399/47, 76, 394, 195
See application file for complete search history.

(56) References Cited

U.S. PATENT DOCUMENTS 6,240,272 B1 * 5/2001 Honda ..... G03G 15/6535 399/315
6,831,672 B2 12/2004 Maeda
6,853,392 B2 2/2005 Maeda
6,862,427 B2 * 3/2005 Sato et al. ..... 399/394
6,999,708 B2 2/2006 Maeda
7,627,277 B2 12/2009 Maeda
7,760,222 B2 7/2010 Maeda
7,940,422 B2 5/2011 Maeda
8,305,416 B2 11/2012 Maeda
8,422,903 B2 4/2013 Maeda
8,866,865 B2 10/2014 Maeda
2007/0046963 A1 * 3/2007 Nagase et al. ..... 358/1.9
2007/0120946 A1 * 5/2007 Hamada ..... G03G 15/5008 347/234
2007/0210245 A1 9/2007 Maeda
2012/0236381 A1 9/2012 Oikawa
2015/0054902 A1 2/2015 Maeda et al.

FOREIGN PATENT DOCUMENTS

JP 2004-009349 1/2004
JP 2012-194468 10/2012

* cited by examiner

*Primary Examiner* — Benjamin Schmitt
(74) *Attorney, Agent, or Firm* — Duft Bornsen & Fettig LLP

(57) ABSTRACT

An image forming apparatus for forming an image on a recording medium includes a first photoconductor on which a first intermediate image of a first color is formed; a second photoconductor on which a second intermediate image of a second color is formed, the second color being different from the first color; first and second light sources configured to emit light to the first and second photoconductors, respectively; a light source control unit configured to control the first light source to emit light according to a light emission control signal; a conveyance control signal generation unit configured to generate a conveyance control signal based on the light emitted from the first light source according to the light emission control signal; and a conveyance unit configured to convey the recording medium based on the conveyance control signal, upon transferring the second intermediate image onto the recording medium.

6 Claims, 15 Drawing Sheets

IMAGE FORMING APPARATUS AND IMAGE FORMING METHOD

CROSS-REFERENCE TO RELATED APPLICATIONS

The present application claims priority to and incorporates by reference the entire contents of Japanese Patent Application No. 2014-094762 filed in Japan on May 1, 2014 and Japanese Patent Application No. 2014-113873 filed in Japan on Jun. 2, 2014.

BACKGROUND OF THE INVENTION

1. Field of the Invention

The disclosures herein generally relate to an image forming apparatus and an image forming method.

2. Description of the Related Art

Conventionally, image forming methods for deflecting light from light sources, detecting the deflected light and performing an image formation using results of detection are known (for example, see Japanese Published Patent Application No. 2012-194468).

Moreover, methods for generating timing signals of colors used in each of a full-color mode and a color reduction mode, for each of the modes, based on scan start signals of beam light are known (for example, see Japanese Published Patent Application No. 2004-9349).

However, in the conventional methods, since signals are not generated based on colors which are preliminarily set, in the case where color modes are changed or the like, it is necessary to adjust timings for conveying recording media.

SUMMARY OF THE INVENTION

It is a general object of at least one embodiment of the present invention to provide an image forming apparatus and an image forming method that substantially obviate one or more problems caused by the limitations and disadvantages of the related art.

In one embodiment, an image forming apparatus for forming an image on a recording medium includes a first photoconductor on which a first intermediate image of a first color is formed; a second photoconductor on which a second intermediate image of a second color is formed, the second color being different from the first color; a first light source configured to emit light to the first photoconductor; a second light source configured to emit light to the second photoconductor; a light source control unit configured to control the first light source to emit light according to a light emission control signal; a conveyance control signal generation unit configured to generate a conveyance control signal based on the light emitted from the first light source according to the light emission control signal; and a conveyance unit configured to convey the recording medium based on the conveyance control signal, upon transferring the second intermediate image onto the recording medium.

In another embodiment, an image forming method for forming an image on a recording medium includes controlling a first light source to emit light according to a light emission control signal, the first light source being configured to emit light to a first photoconductor on which a first intermediated image of a first color is formed; generating a conveyance control signal based on the light emitted from the first light source according to the light emission control signal; and conveying the recording medium based on the conveyance control signal, upon transferring a second intermediate image of a second color onto the recording medium, the second intermediate image being formed on a second photoconductor, and the second color being different from the first color.

According to the embodiment of the present invention, an image forming apparatus and an image forming method, in which a timing for conveying a recording medium is not changed, can be provided.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

In the following, embodiments of the present invention will be described with reference to the accompanying drawings.

First Embodiment

Schematic Configuration of Image Forming Apparatus

Figure 1:
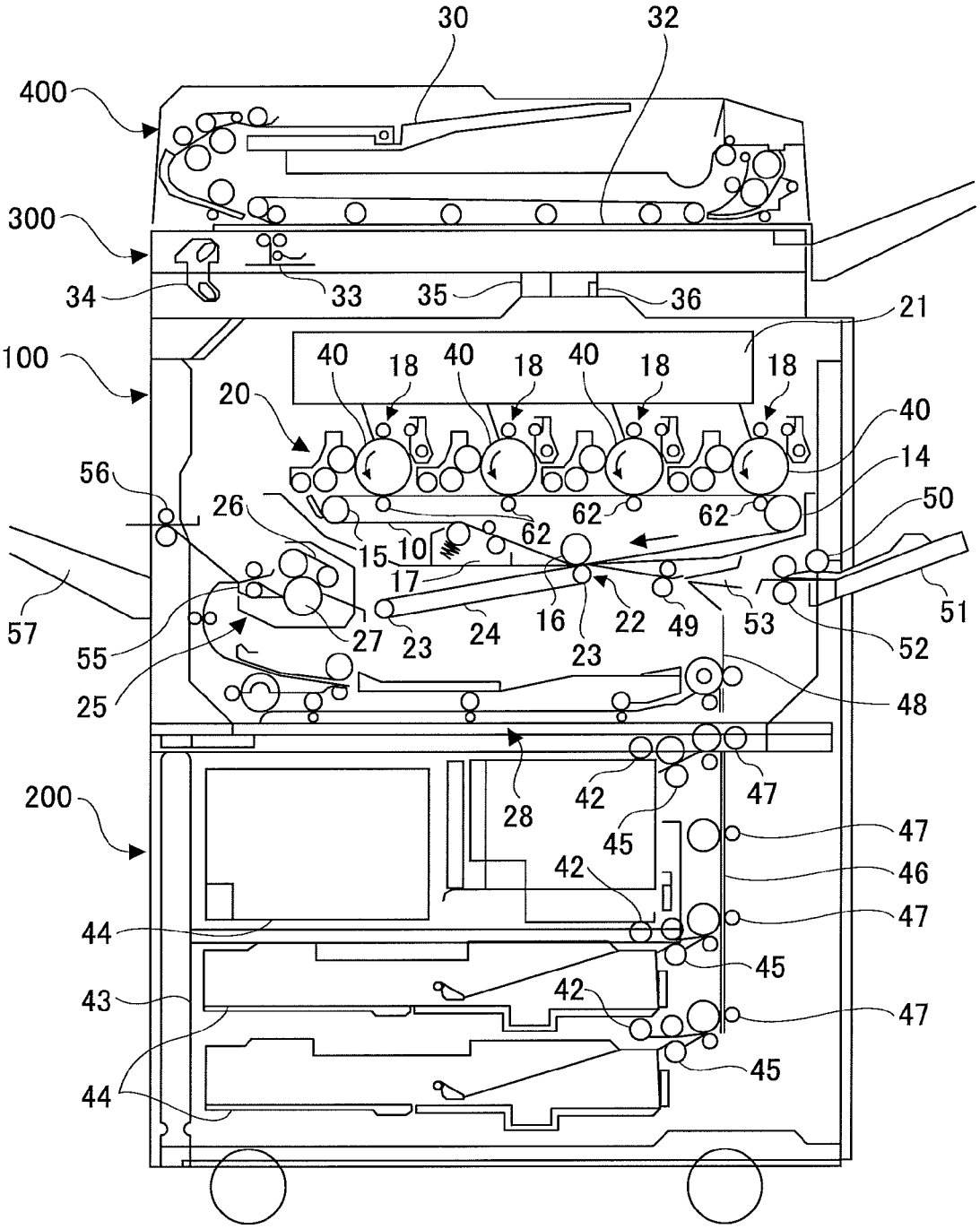
FIG. 1 is a schematic diagram for explaining an example of an overall configuration of an image forming apparatus according to a present embodiment.

FIG. 1 is a schematic diagram for explaining an example of an overall configuration of an image forming apparatus 100 according to the present embodiment.

The image forming apparatus 100 is an electrophotographic type image forming apparatus including a secondary transfer mechanism referred to as a "tandem system" for forming color images, for example. In the following, the image forming apparatus 100 will be explained as an example.

The image forming apparatus 100 includes an intermediate transfer unit (not shown). The intermediate transfer unit includes an intermediate transfer belt 10 which is an endless belt. The intermediate transfer belt 10 is wound on three support rollers 14 to 16, and rotates in the clockwise direction, in the case of FIG. 1.

An intermediate transfer material cleaning unit 17 removes toner which remains on the intermediate transfer belt 10 after an image formation process is performed.

The image formation device 20 includes a cleaning unit 13, a charging unit 18, a discharge unit 19, a developing unit 29 and a photoconductor unit 40.

The image forming apparatus 100 includes, in the case of FIG. 1, separate image formation devices 20 corresponding to respective colors, i.e. yellow (Y), magenta (M), cyan (C) and black (K) (in the following, characters in parentheses will represent the colors). The image forming apparatus 100 further includes a light beam scanning device 21, a secondary transfer unit 22, a fixing unit 25 and a sheet reversing unit 28.

The image formation devices 20 are arranged between the first support roller 14 and the second support roller 15. The image formation devices 20 for the respective colors are arranged in the order of yellow (Y), magenta (M), cyan (C) and black (K) in the conveyance direction of the intermediate transfer belt 10.

The image formation devices 20 are attachable to or detachable from the image forming apparatus 100. The image formation device 20 will be described later in detail.

The light beam scanning device 21 emits a light beam for forming an image to a photoconductor drum in the photoconductor unit 40 of each of the colors.

The secondary transfer unit 22 includes two rollers 23 and a secondary transfer belt 24.

The secondary transfer belt 24 is an endless belt. The secondary transfer belt 24 is wound on the two rollers 23 and rotates. The rollers 23 and the secondary transfer belt 24 are arranged so as to push up the intermediate transfer belt 10 to press against the third support roller 16.

The secondary transfer belt 24 transfers an image formed on the intermediate transfer belt 10 onto a recording medium. The recording medium includes, for example, a paper, a plastic sheet or the like. In the following the case where the recording medium is a paper will be explained as an example.

The fixing unit 25 performs a fixing process. To the fixing unit 25 a recording medium, on which a toner image is transferred, is sent. The fixing unit 25 includes a fixing belt 26 and a pressure roller 27. The fixing belt 26 is an endless belt. The fixing belt 26 and the pressure roller 27 are arranged so that the pressure roller 27 is pressed against the fixing belt 26. The fixing unit 25 performs heating.

The sheet reversing unit 28 reverses a front side and a back side of a conveyed recording medium. The sheet reversing unit 28 is used in the case where after an image is formed on the front side another image is formed on the back side.

The image forming apparatus 100 further includes an auto document feeder (ADF) 400 and an image reading unit 300. The ADF 400 conveys a recording medium onto a contact glass 32 in the case where a start button in an operation unit (not shown) is pressed and the recording medium is placed on a paper feeding base 30. In the case where there is not a recording medium on the paper feeding base 30, the ADF 400 activates the image reading unit 300 in order to read a recording medium which a user placed on the contact glass 32.

The image reading unit 300 includes a first carriage 33, a second carriage 34, an image formation lens 35, a charge coupled device (CCD) 36 and a light source (not shown).

In the case of reading the recording medium on the contact glass 32, the image reading unit 300 operates the first carriage 33 and the second carriage 34.

A light source in the first carriage 33 emits light to the contact glass 32. The light from the light source in the first carriage 33 is reflected onto the recording medium on the contact glass 32.

The reflected light is further reflected on a first mirror (not shown) in the first carriage 33 toward the second carriage 34. The reflected light toward the second carriage 34 forms an image at the CCD 36 via the image formation lens 35.

The image forming apparatus 100 generates image data corresponding to the respective colors including Y, M, C, K and the like based on information acquired by the CCD 36.

In the case where an external device (not shown) such as a PC (personal computer) instructs to form an image, upon the start button in the operation unit (not shown) being pressed, the image forming apparatus 100 starts the rotation of the intermediate transfer belt 10. Moreover, in the case where a facsimile output is instructed, the image forming apparatus 100 starts the rotation of the intermediate transfer belt 10.

When the intermediate transfer belt 10 starts rotating, the image formation device 20 starts an image formation process. A recording medium on which a toner image is transferred is conveyed to the fixing unit 25. According to a fixing process being performed by the fixing unit 25, an image is formed on the recording medium.

Below the image forming apparatus 100 a paper feeding table 200 is provided. The paper feeding table 200 includes a paper feeding roller 42, a paper feeding unit 43, a separation roller 45 and a conveyance roller unit 46. The paper feeding unit 43 may include plural paper feeding trays 44. The conveyance roller unit 46 includes a conveyance roller 47.

The paper feeding table 200 selects one of paper feeding rollers 42. The paper feeding table 200 rotates the selected paper feeding roller 42.

The paper feeding unit 43 selects one of the plural paper feeding trays 44, and sends out a recording medium from the selected paper feeding tray 44. The recording medium sent out from the paper feeding tray 44 is separated into a sheet by the separation roller 45 and enters into the conveyance roller unit 46.

The conveyance roller unit 46 sends a recording medium to the image forming apparatus 100 by the conveyance roller 47.

In the image forming apparatus 100, the recording medium is sent to the registration roller 49 by the conveyance roller unit 48. The recording medium sent toward the registration roller 49 is stopped by abutting on the registration roller 49. When a toner image enters the secondary transfer unit 22, the recording medium is conveyed to the secondary transfer unit 22 at a timing for performing a transfer on a predetermined position.

A recording medium may be sent from a manual feed tray 51. In the case of sending the recording medium from the manual feed tray 51, the image forming apparatus 100 rotates a paper feeding roller 50 and a paper feeding roller 52.

The paper feeding rollers 50 and 52 separate one sheet of recording medium from plural recording media placed on the manual feed tray 51. The paper feeding rollers 50 and 52 send the separated recording medium to a paper feeding path 53. The recording medium sent to the paper feeding path 53 is further sent to the registration roller 49. Processes after the recording medium is sent to the registration roller 49 are the same as the case of sending the recording medium from the paper feeding table 200.

The recording medium is fixed by the fixing unit 25 and ejected. The recording medium ejected from the fixing unit 25 is sent toward an ejection roller 56 by a changeover claw 55. The ejection roller 56 sends the recording medium which was sent to the paper ejection tray 57.

Moreover, the changeover claw 55 may send the recording medium ejected from the fixing unit 25 toward the sheet reversing unit 28. The sheet reversing unit 28 reverses a front side and a back side of the recording medium which was sent. On the back side of the reversed recording medium, an image is formed as on the front side, i.e. a double-sided printing is performed, and the recording medium is sent to the paper ejection tray 57.

On the other hand, toner remaining on the intermediate transfer belt 10 is removed by the intermediate transfer material cleaning unit 17. Upon removing the toner remaining on the intermediate transfer belt 10, the image forming apparatus 100 is prepared for the next image formation.

The configuration of the image forming apparatus 100 is not limited to that shown in FIG. 1. The image forming apparatus 100 may perform an image formation using five or more colors. In the case where the image forming apparatus 100 uses five or more colors, the number of image formation devices 20 is changed correspondingly to the number of colors which are used. In the following, the image formation devices 20, which perform an image formation by using five colors, white (W), yellow (Y), magenta (M), cyan (C) and black (K), will be explained as an example.

<Image Formation Device>

Figure 2:
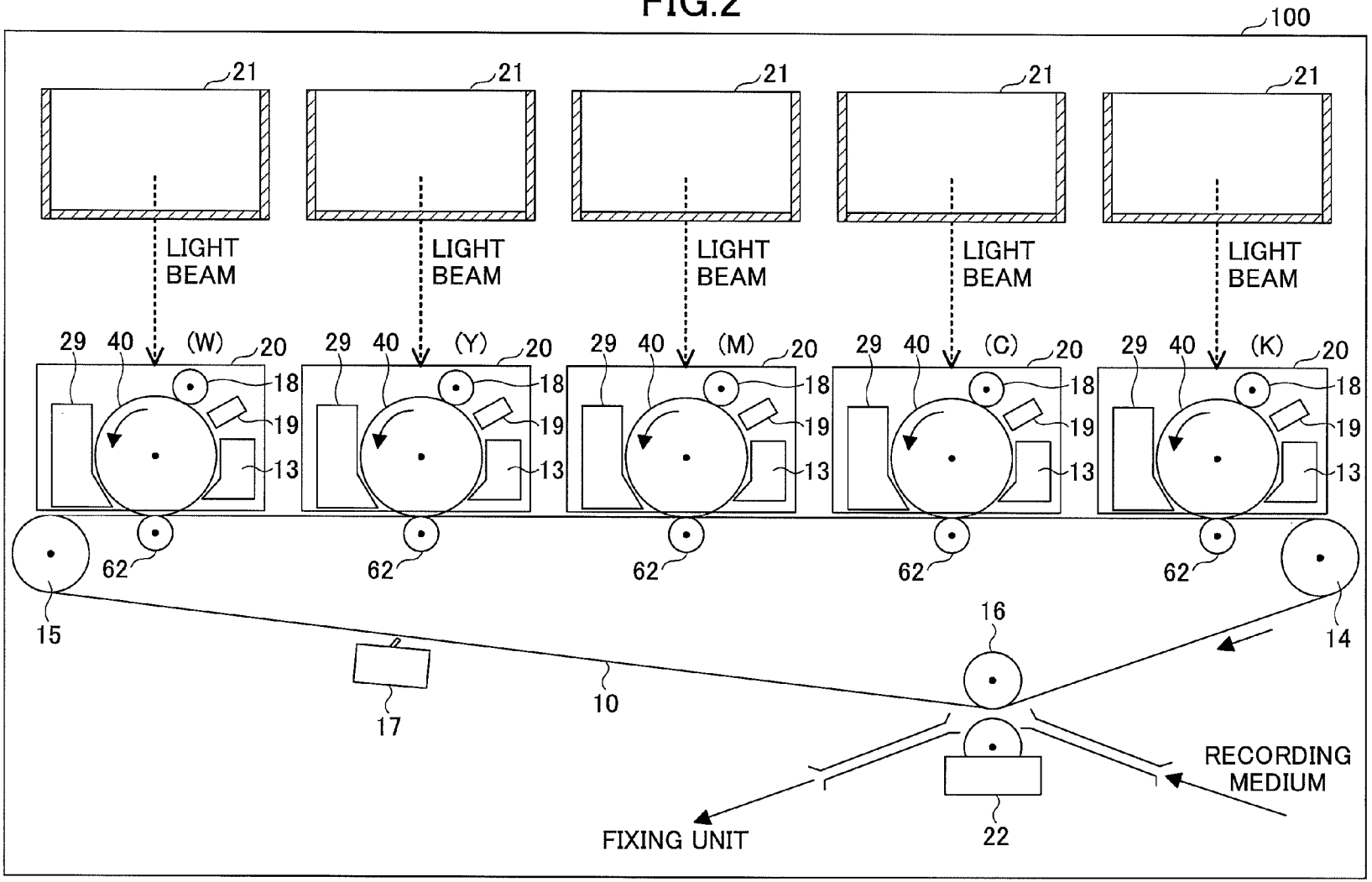
FIG. 2 is a schematic diagram for explaining an example of a configuration of an image formation device according to the present embodiment.

FIG. 2 is a schematic diagram for explaining an example of a configuration of the image formation device according to the present embodiment.

The image forming apparatus 100 includes the intermediate transfer belt 10, the image formation devices 20 corresponding to the respective colors, the light beam scanning devices 21 corresponding to the respective colors, the intermediate transfer material cleaning unit 17 and the secondary transfer unit 22.

A light beam is incident from the light beam scanning device 21 into the image formation device 20. The light beam scanning device 21 will be described later in detail.

The image formation device 20 performs image formation processes based on the incident light beam. The electrophotographic image formation process includes five processes of charging, exposure, developing, transfer and fixing. The image formation process of the image formation device includes charging, exposure, developing and transfer.

The image formation devices 20, in the image formation process, form toner images of the respective colors on the intermediate transfer belt 10. The toner images of the respective colors formed by the image formation devices 20 of the respective colors are overlaid in order, and thereby a toner image of five colors are formed.

A light beam modulated based on image data is incident into the photoconductor unit 40 in the image formation device 20.

The charging unit 18 performs a charging process. In the changing process, a surface of the photoconductor unit 40 is charged by the charging unit 18.

An exposure process is performed by the light beam on the charged photoconductor unit 40. In the exposure process, an electrostatic latent image (intermediate image) is formed on the surface of the photoconductor unit 40.

The developing unit 29 performs a developing process. In the developing process, toner is adhered to the electrostatic latent image formed on the photoconductor unit 40, and a toner image is formed. Toner is supplied from a toner bottle (not shown) to the developing unit 29.

The toner image is transferred onto the intermediate transfer belt 10 by a transferor 62.

Formed toner images of the respective colors are overlaid on each other on the intermediate transfer belt 10, and transferred onto a recording medium as a toner image.

After the transfer, the discharge unit 19 discharges the photoconductor unit 40, and the cleaning unit 13 removes a toner image.

When the transferred toner image enters the secondary transfer unit 22, a medium is sent to the secondary transfer unit 22. The toner image on the intermediate transfer belt 10 is transferred onto a recording medium sent to the secondary transfer unit 22.

The secondary transfer unit 22 transfers the toner image of five colors formed on the intermediate transfer belt 10 onto the recording medium. Afterwards, the fixing unit 25 performs fixing process.

The intermediate transfer material cleaning unit 17 removes the toner image of five colors after the transfer process.

<Light Beam Scanning Device>

Figure 3:
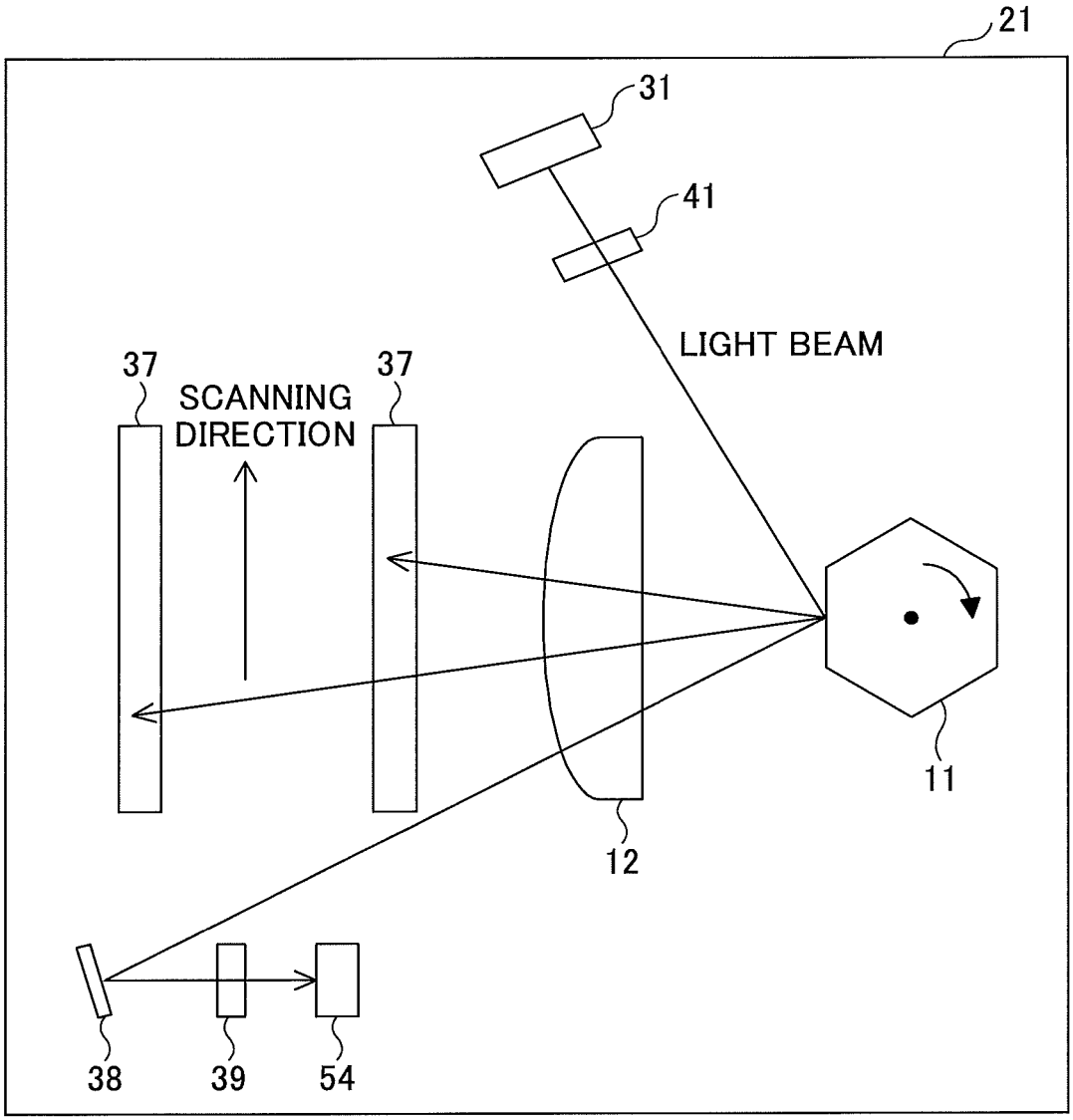
FIG. 3 is a schematic diagram for explaining an example of a configuration of a light beam scanning device according to the present embodiment.

FIG. 3 is a schematic diagram for explaining an example of a configuration of the light beam scanning device according to the present embodiment. FIG. 3 is a top view illustrating the light beam scanning device 21 shown in FIG. 2 viewed above. The light beam scanning devices 21 of the respective colors have the same configuration.

The light beam scanning device 21 includes an LD (Laser Diode) 31 and various mirrors 37 and 38. The light beam scanning device 21 further includes various lenses 12, 39 and 41, a synchronization sensor 54 and a polygon mirror 11.

The LD 31 is a light source that emits a light beam. In the following, the case where the light source is an LD will be explained as an example.

The LD 31 performs lighting and extinguishing based on image data input to the image forming apparatus 100. A light beam emitted from the LD 31 passes through a cylinder lens 41 and is reflected at the polygon mirror 11. The polygon mirror 11 rotates by a motor (not shown) and deflects the incident light beam. Meanwhile, the light beam scanning device 21 may include plural LDs 31 or may include a light source shared for plural colors.

Light reflected at the polygon mirror 11 passes through an fθ lens 12 and is incident into a reflecting mirror 37. Light reflected at the reflecting mirror 37 is incident into the image formation device 20 of each color and scans the photoconductor unit 40.

In an end part including a writing start position in a main-scanning direction, light passed through the fθ lens 12 is reflected at a synchronization mirror 38, passes through a synchronization lens 39 and is incident into the synchronization sensor 54. The synchronization sensor 54 detects a timing of a writing start in the main-scanning direction from the incident light.

Meanwhile, the main-scanning direction is orthogonal to the conveyance direction of a recording medium. A sub-scanning direction is parallel to the conveyance direction of a recording medium. In the following, the main-scanning direction and the sub-scanning direction will be described in the same way.

<Functional Configuration>

Figure 4:
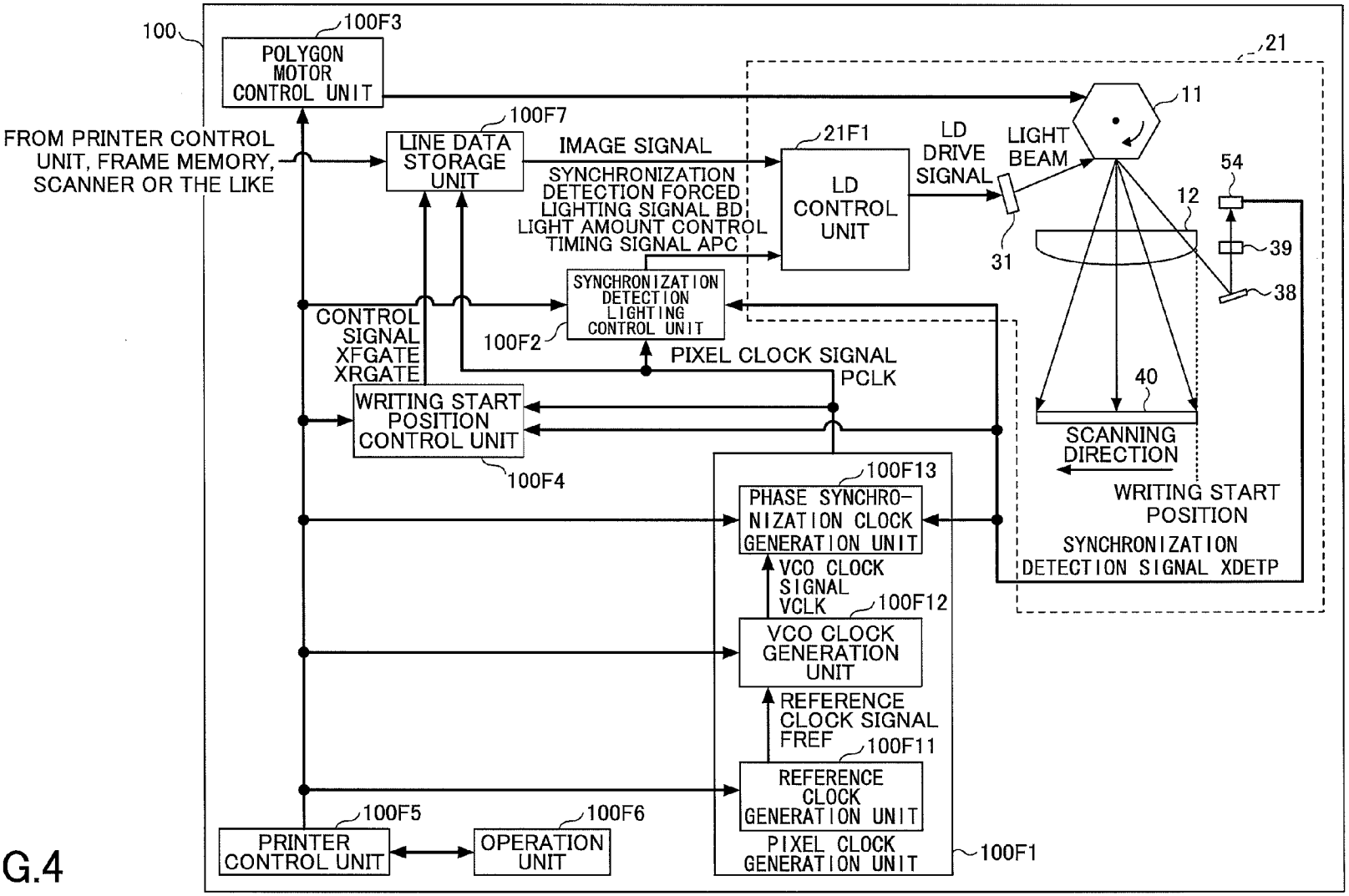
FIG. 4 is a functional block diagram for explaining an example of an image formation control unit and the light beam scanning device according to the present embodiment.

FIG. 4 is a functional block diagram for explaining an example of an image formation control unit and the light beam scanning device according to the present embodiment.

Signals of image data are input at a timing in synchronization with a synchronization detection forced lighting signal BD, a light amount control timing signal APC and a pixel clock signal PCLK.

The image forming apparatus 100 includes a pixel clock generation unit 100F1, a synchronization detection lighting control unit 100F2, a polygon motor control unit 100F3 and a line data storage unit 100F7. The image forming apparatus 100 further includes a writing start position control unit 100F4, a printer control unit 100F5 and an operation unit 100F6.

The image forming apparatus 100 includes the respective units 100F1 to 100F4 and 100F7, other than the printer control unit 100F5 and the operation unit 100F6, for each of the colors.

In the light beam scanning device 21, as shown in FIG. 4, the synchronization sensor 54 is provided on a side of the writing start position. A light beam passes through the fθ lens 12 at the writing start position, as explained with reference to FIG. 3, and is reflected at the synchronization mirror 38. A light beam reflected at the synchronization mirror 38 passes through the synchronization lens 39, and is incident into the synchronization sensor 54. In the case where the light beam is incident into the synchronization sensor 54, the synchronization sensor 54 outputs a synchronization detection signal XDETP. The synchronization detection signal XDETP is output to the pixel clock generation unit 100F1, the synchronization detection lighting control unit 100F2 and the writing start position control unit 100F4.

The pixel clock generation unit 100F1 generates a pixel clock signal PCLK in synchronization with the synchronization detection signal XDETP. The pixel clock signal PCLK is output to the synchronization detection lighting control unit 100F2, the writing start position control unit 100F4 and the line data storage unit 100F7.

The pixel clock generation unit 100F1 includes a reference clock generation unit 100F11, a VCO (Voltage Controlled Oscillator) clock generation unit 100F12 and a phase synchronization clock generation unit 100F13.

The reference clock generation unit 100F11 generates a reference clock signal FREF which is a clock signal to be a reference.

The VCO clock generation unit 100F12 generates a VCO clock signal VCLK.

Figure 5:
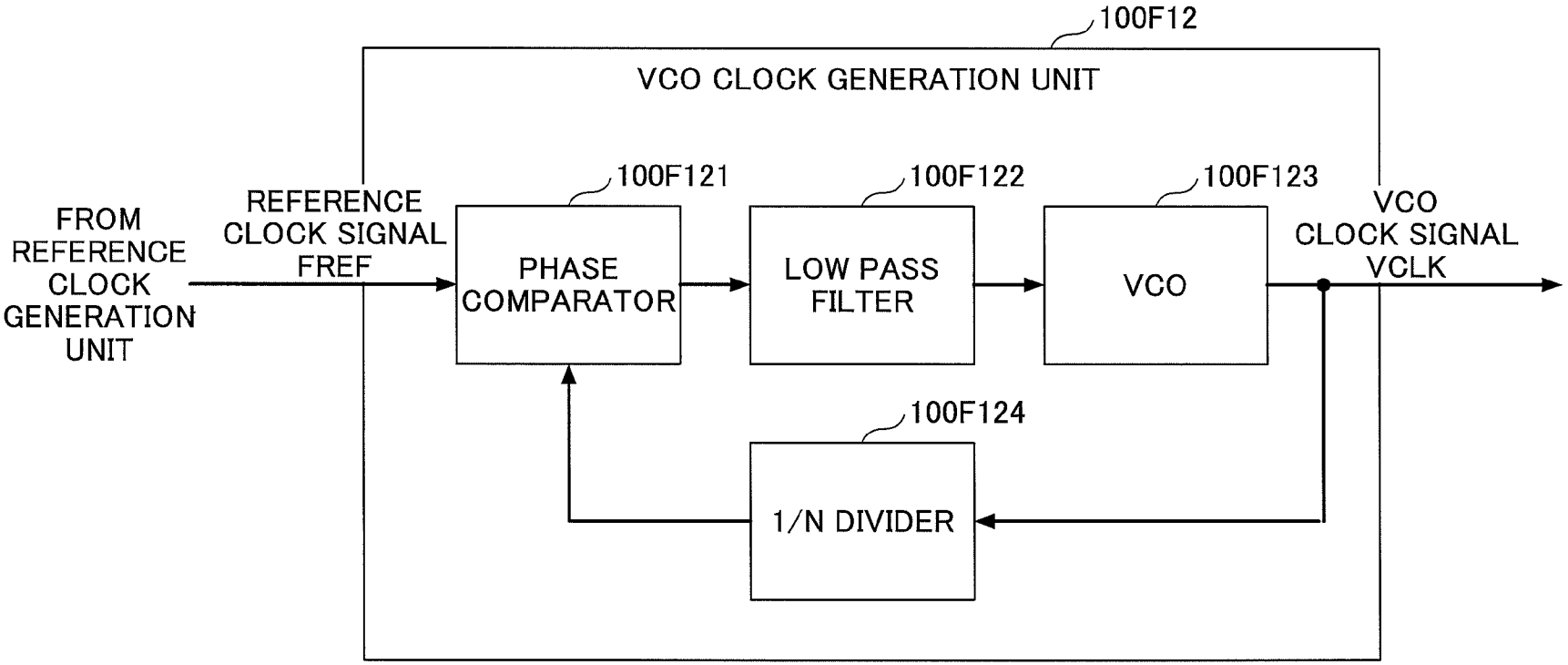
FIG. 5 is a functional block diagram for explaining an example of a VCO clock generation unit according to the present embodiment.

FIG. 5 is a functional block diagram for explaining an example of the VCO clock generation unit according to the present embodiment.

The VCO clock generation unit 100F12 includes a phase comparator 100F121, a low pass filter 100F122, a VCO 100F123 and a 1/N divider 100F124.

To the phase comparator 100F121, a reference clock signal FREF, which is an input signal from the reference clock generation unit 100F11 shown in FIG. 4, and a VCO clock signal VCLK subjected to 1/N division from the 1/N divider 100F124 are input. The phase comparator 100F121 compares phases of falling edges of the two input signals, and outputs an error component with a predetermined electric current to the low pass filter 100F122.

The low pass filter 100F122 removes a noise or the like, which is a high-frequency component, from the output from the phase comparator 100F121, and outputs a direct-current voltage to the VCO 100F123.

The VCO 100F123 outputs a VCO clock signal VCLK having a predetermined frequency based on the output from the low pass filter 100F122.

The 1/N divider 100F123 divides the input VCO clock signal VCLK into 1/N with a set division ratio N.

Meanwhile, a frequency of the reference clock signal and the division ratio N can be set from the printer control unit 100F5. The pixel clock generation unit 100F1 can change the frequency of the VCO clock signal VCLK by changing the frequency of the reference clock signal and the division ratio N.

To the phase synchronization clock generation unit 100F13, the VCO clock signal VCLK, and the synchronization detection signal XDETP are input. The phase synchronization clock generation unit 100F13 outputs the pixel clock signal PCLK synchronized with the synchronization detection signal XDETP to the synchronization detection lighting control unit 100F2, the writing start position control unit 100F4 and the line data storage unit 100F7. The frequency of the pixel clock signal PCLK can be changed based on the frequency of the VCO clock signal VCLK.

The synchronization detection lighting control unit 100F2 asserts the synchronization detection forced lighting signal BD in order to output the synchronization detection signal XDETP to the synchronization sensor 54. The synchronization detection forced lighting signal BD is output to an LD control unit 21F1. In the case where the asserted synchronization detection forced lighting signal BD is input to the LD control unit 21F1, the LD control unit controls the light source to emit light.

The synchronization detection lighting control unit 100F2, upon detecting the synchronization detection signal XDETP, asserts the synchronization detection forced lighting signal BD at a timing in which flare light does not occur based on the synchronization detection signal XDETP and the pixel clock signal PCLK.

Figure 6:
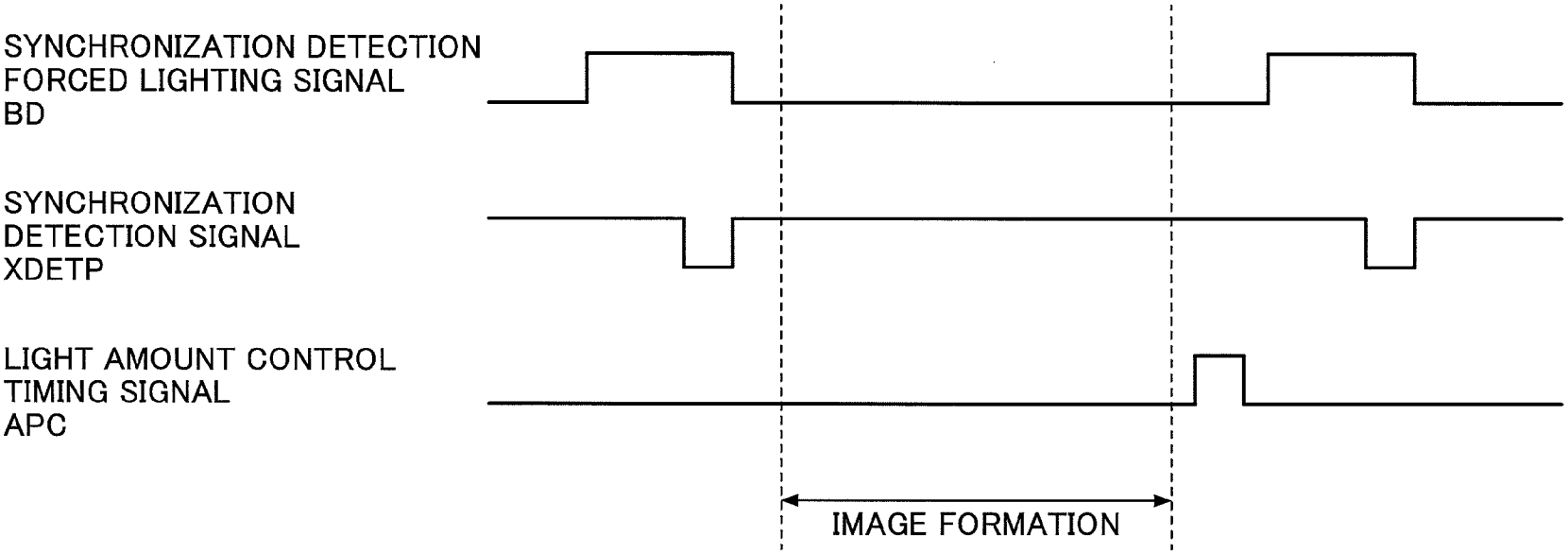
FIG. 6 is a timing chart for explaining an example of a timing of an output signal from a synchronization detection lighting control unit according to the present embodiment.

FIG. 6 is a timing chart for explaining an example of a timing of an output signal from the synchronization detection lighting control unit according to the present embodiment.

In FIG. 6, the synchronization detection forced lighting signal BD and the light amount control timing signal APC are signals in which High levels represent asserted states, i.e. so-called "high active signals". In FIG. 6, the synchronization detection signal XDETP is a signal in which Low levels represent asserted states, i.e. so-called "low active signal".

As shown in FIG. 6, the light amount control timing signal APC is asserted at a timing other than the image formation. That is, processing of the light amount control timing signal APC is executed at a timing where the image formation is not performed since the LD is lighted.

The synchronization detection forced lighting signal BD is asserted at a timing where the image formation is not performed and the processing of the light amount control timing signal APC is not executed, as shown in FIG. 6.

The synchronization detection lighting control unit 100F2 outputs the APC signal and the synchronization detection forced lighting signal BD to the LD control unit 21F1 at a timing as shown in FIG. 5.

Meanwhile, the timings for asserting the light amount control timing signal APC and the synchronization detection forced lighting signal BD are not limited to the case shown in FIG. 6. For example, in the case where the light beam scanning device 21 is provided with an LD array including plural light sources and a photo diode (PD) for measuring a light amount, it is necessary to perform the processing of the light amount control timing signal APC for each of the light sources. Accordingly, the light amount control timing signal APC may be asserted corresponding to a number of the light sources.

The polygon motor control unit 100F3 performs rotation control for controlling a rotational speed of a polygon motor (not shown) for rotating the polygon mirror 11 based on a control by the printer control unit 100F5.

To the writing start position control unit 100F4, the synchronization detection signal XDETP, the pixel clock signal PCLK, and a setting signal and a print start signal from the printer control unit 100F5 are input. The writing start position control unit 100F4 generates a main scanning control signal XRGATE which is a control signal for the main-scanning direction in order to determine a writing start timing of an image and a width where the image formation is performed, and a sub scanning control signal XFGATE which is a control signal for the sub-scanning direction.

A control signal is, for example, the sub scanning control signal XFGATE. In the following, the sub scanning control signal XFGATE will be explained as an example.

Figure 7:
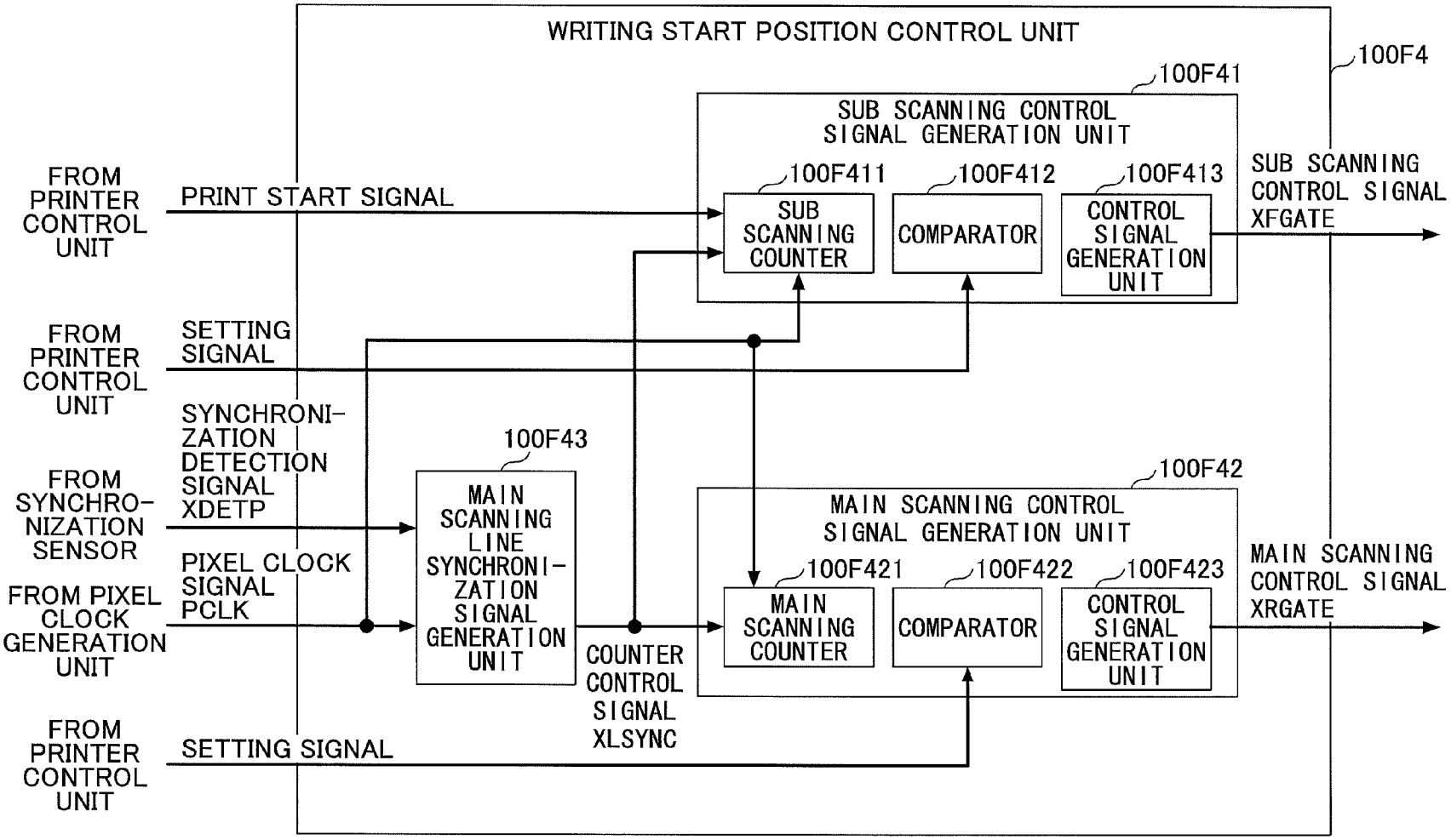
FIG. 7 is a functional block diagram for explaining an example of a writing start position control unit according to the present embodiment.

FIG. 7 is a functional block diagram for explaining an example of the writing start position control unit according to the present embodiment.

The writing start position control unit 100F4 includes a sub scanning control signal generation unit 100F41, a main scanning control signal generation unit 100F42 and a main scanning line synchronization signal generation unit 100F43.

The main scanning line synchronization signal generation unit 100F43 generates a counter control signal XLSYNC which is a signal for operating a sub scanning counter 100F411 and a main scanning counter 100F421.

The sub scanning control signal generation unit 100F41 includes a sub scanning counter 100F411, a comparator 100F412 and a control signal generation unit 100F413.

The sub scanning control signal generation unit 100F41 generates a sub scanning control signal XFGATE. The sub scanning control signal XFGATE is a signal for determining a timing for capturing an image signal, i.e. a timing for writing an image in the sub-scanning direction.

The sub scanning counter 100F411 is a counter that starts an operation by a print start signal from the printer control unit 100F5 and is counted up for each counter control signal XLSYNC.

The comparator 100F412 compares a counter value by the sub scanning counter 100F411 and a setting value by a setting signal from the printer control unit 100F5, and outputs a result of comparison.

The control signal generation unit 100F413 generates a sub scanning control signal XFGATE based on the comparison result from the comparator 100F412.

The main scanning control signal generation unit 100F42 includes a main scanning counter 100F421, a comparator 100F422 and a control signal generation unit 100F423.

The main scanning control signal generation unit 100F42 generates a main scanning control signal XRGATE. The main scanning control signal XRGATE is a signal for determining a timing for capturing an image signal, i.e. a timing for writing an image in the main-scanning direction.

The main scanning counter 100F421 is a counter that starts an operation by the counter control signal XLSYNC and is counted up for each pixel clock signal PCLK.

The comparator 100F422 compares a counter value by the main scanning counter 100F421 and a setting value by a setting signal from the printer control unit 100F5, and outputs a result of comparison.

The control signal generation unit 100F423 generates a main scanning control signal XRGATE based on the comparison result from the comparator 100F422.

The writing start position control unit 100F4 can correct a writing position with a setting value in a unit of a cycle of the pixel clock signal PCLK in the main-scanning direction, i.e. in a unit of a dot. Moreover, the writing start position control unit 100F4 can correct a writing position with a setting value in a unit of a cycle of the counter control signal XLSYNC in the sub-scanning direction, i.e. in a unit of a line. Correction data to be the setting values are stored in a storage unit (not shown) of the printer control unit 100F5.

The printer control unit 100F5 controls the respective units included in the image forming apparatus 100. The operation unit 100F6 causes a user of the image forming apparatus 100 to input an operation.

The line data storage unit 100F7 stores one line of data. The line data storage unit 100F7 is realized by a line memory 70. The line memory will be described later in detail.

The respective units other than the operation unit 100F6 explained with reference to FIG. 4 are realized by electronic circuits, for example, according to ASIC (Application Specific Integrated Circuit) (not shown) or the like. The operation unit 100F6 is realized by an operation panel (not shown) configured by a touch panel or the like. Meanwhile, a part of or whole of the processes performed in the respective units may be realized by a CPU (Central Processing Unit) (not shown) or the like.

<Main-Scanning Direction>

Figure 8:
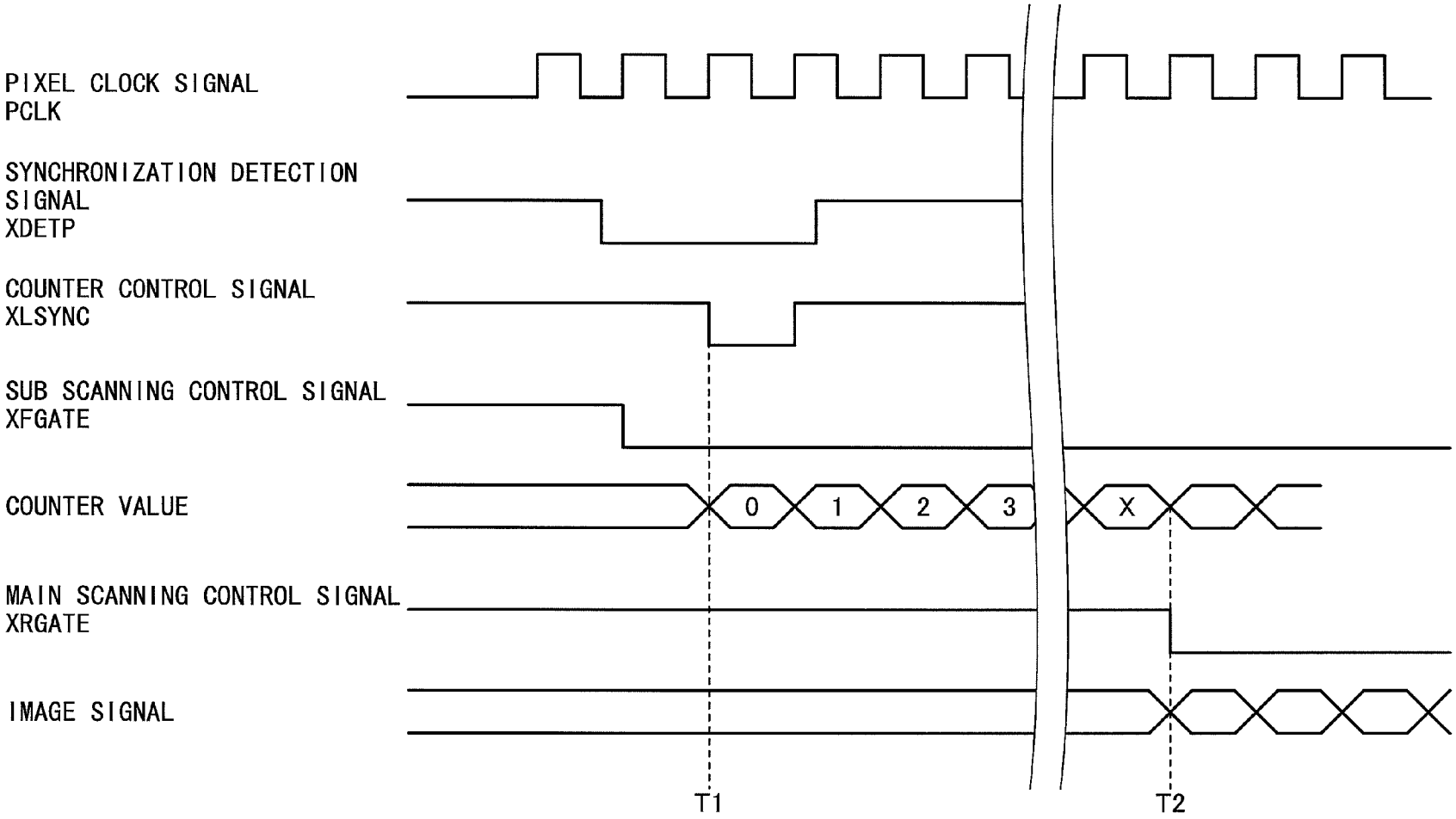
FIG. 8 is a timing chart for explaining an example of control in a main-scanning direction by the writing start position control unit according to the present embodiment.

FIG. 8 is a timing chart for explaining an example of control in the main-scanning direction by the writing start position control unit according to the present embodiment.

In FIG. 8, the pixel clock signal PCLK is a clock signal. At a timing of a rising edge of the pixel clock signal PCLK, the respective counters operate. In FIG. 8, a synchronization detection signal XDETP, a counter control signal XLSINC, a sub scanning control signal XFGATE and a main scanning control signal XRGATE are signals in which Low levels represent asserted states, i.e. so-called "low active signals".

The main scanning counter 100F421 shown in FIG. 7 sets a counter value to "0", i.e. so-called "resetting" a counter, at a timing T1 when the counter control signal XLSYNC is asserted, as shown in FIG. 8. After the timing T1, the main scanning counter 100F421 shown in FIG. 7 counts up the counter value for each pixel clock signal PCLK, as shown in FIG. 8.

For example, in the case where a setting value "X" is input by the setting signal shown in FIG. 7, the comparator 100F422 shown in FIG. 7 determines whether the counter value to be counted up reaches the setting value "X". In the case where the counter value reaches the setting value "X", the comparator 100F422 shown in FIG. 7 outputs a comparison result that the counter value reaches the setting value "X". Based on the result of reaching the setting value "X", the control signal generation unit 100F423 shown in FIG. 7 asserts the main scanning control signal XRGATE. The image forming apparatus 100, as shown in FIG. 8, from a timing T2 when the main scanning control signal XRGATE is asserted, starts capturing image signals, i.e. starts an image formation. Based on the image signal captured from the timing T2, the image forming apparatus performs the image formation. The main scanning control signal XRGATE is a signal which is asserted for a width of an image in the main-scanning direction.

<Sub-Scanning Direction>

Figure 9:
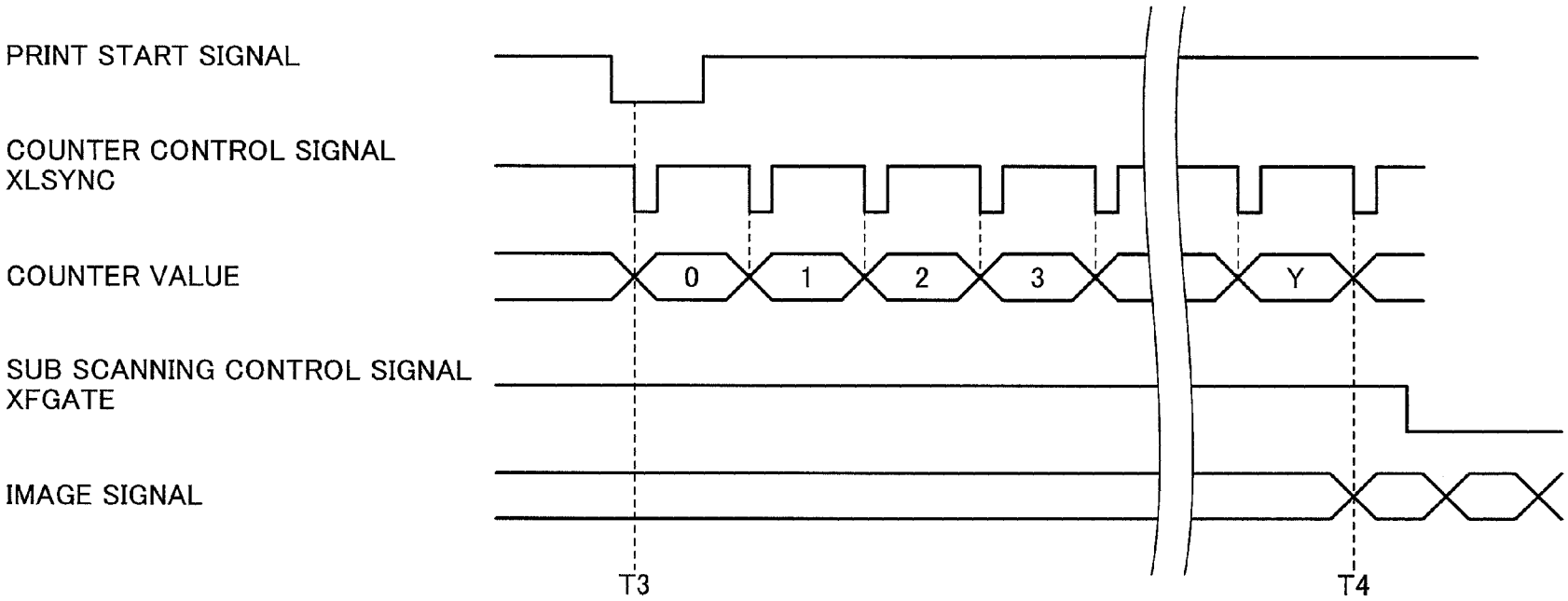
FIG. 9 is a timing chart for explaining an example of control in a sub-scanning direction by the writing start position control unit according to the present embodiment.

FIG. 9 is a timing chart for explaining an example of control in the sub-scanning direction by the writing start position control unit according to the present embodiment.

In FIG. 9, the print start signal, the counter control signal XLSYNC and the sub scanning control signal XFGATE are signals in which Low levels represent asserted states, i.e. so-called "low active signals".

The sub scanning counter 100F411 shown in FIG. 7 sets a counter value to "0", i.e. so-called "resets" a counter, at a timing T3 when the print start signal is asserted, as shown in FIG. 9. After the timing T3, the sub scanning counter 100F411 shown in FIG. 7 counts up the counter value every time the counter control signal XLSYNC is asserted, as shown in FIG. 9.

For example, in the case where a setting value "Y" is input by the setting signal shown in FIG. 7, the comparator 100F412 determines whether the counter value to be counted up reaches the setting value "Y". In the case where the counter value reaches the setting value "Y", the comparator 100F412 shown in FIG. 7 outputs a comparison result that the counter value reaches the setting value "Y". Based on the result of reaching the setting value "Y", the control signal generation unit 100F413 shown in FIG. 7 asserts the sub scanning control signal XFGATE. The image forming apparatus 100, as shown in FIG. 8, from a timing T4 when the sub scanning control signal XFGATE is asserted, starts capturing image signals, i.e. starts an image formation. Based on the image signal captured from the timing T4, the image forming apparatus performs the image formation. The sub scanning control signal XFGATE is a signal which is asserted for a length of an image in the sub-scanning direction.

<Capturing Image Signals>

Figure 10:
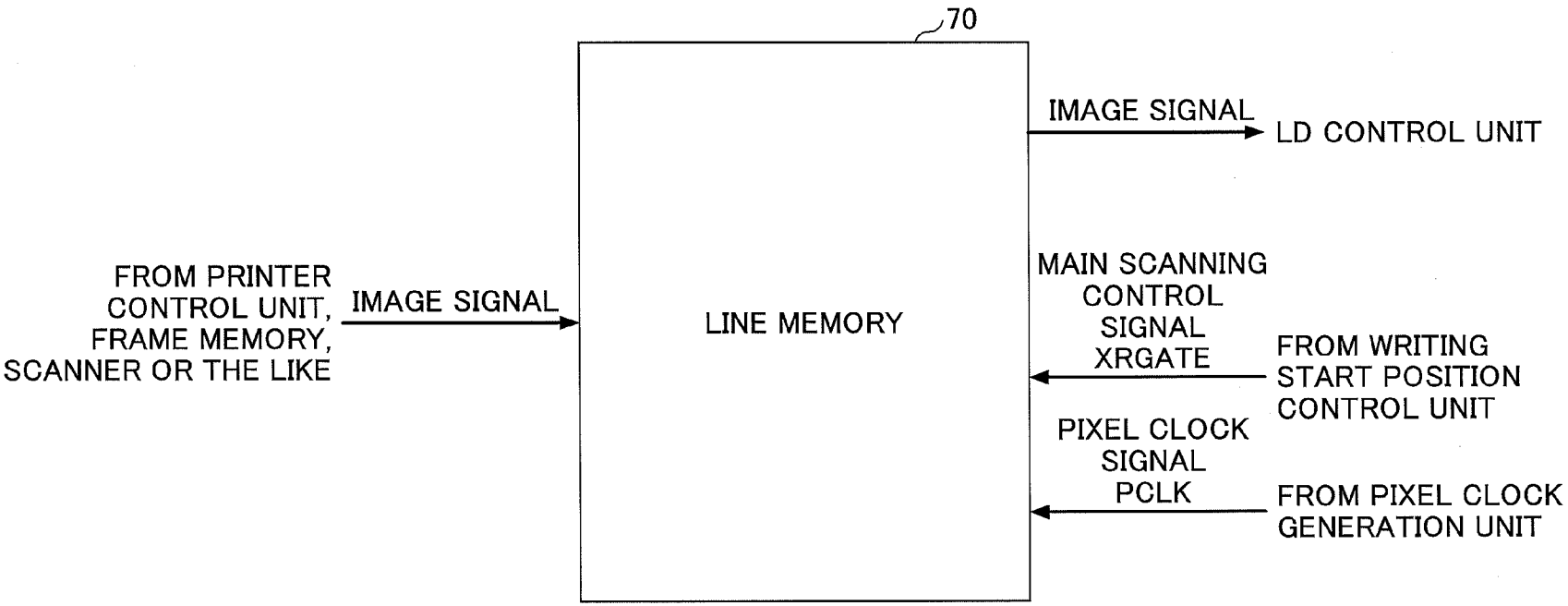
FIG. 10 is a functional block diagram for explaining an example of a configuration for realizing capturing of image signals according to the present embodiment.

FIG. 10 is a functional block diagram for explaining an example of a configuration for realizing a capture of image signals according to the present embodiment.

The image forming apparatus 100 includes a line memory 70. The line memory 70 stores image data which are input as image signals.

The line memory 70 outputs an image signal in synchronization with the pixel clock signal PCLK which is input. The line memory 70 outputs the image signal to the LD control unit 21F1 shown in FIG. 4 based on the main scanning control signal XRGATE which is input. That is, the line memory 70 performs a process of the former step of the LD control unit 21F1. The line memory 70 outputs an image signal, which is input from the printer control unit 100F5 shown in FIG. 4, a frame memory (not shown), a scanner (not shown) or the like, to the LD control unit 21F1 shown in FIG. 4. The LD control unit 21F1 shown in FIG. 4 lights the LD 31 shown in FIG. 4 at a timing output from the line memory 70.

<LD Control Unit>

Figure 11:
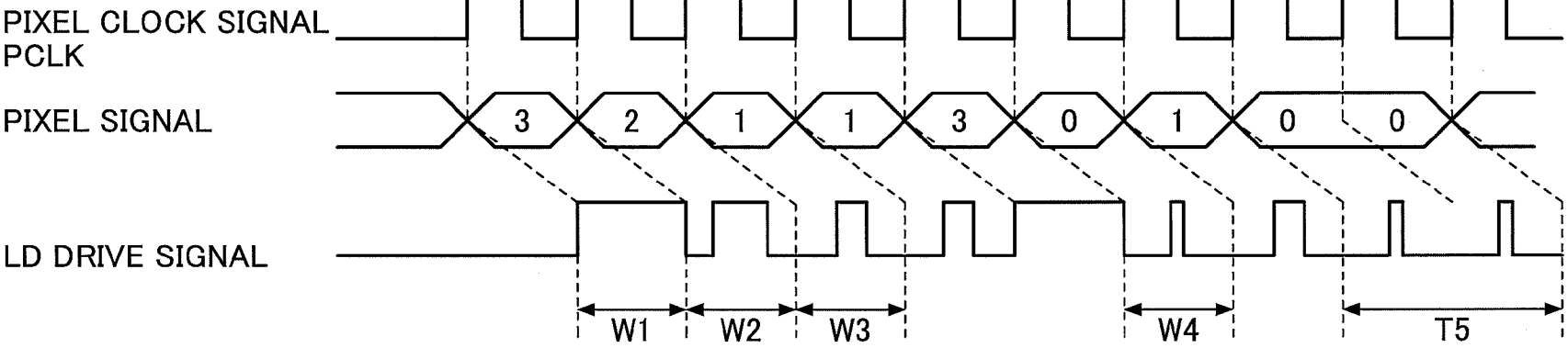
FIG. 11 is a timing chart for explaining an example of control of lighting and extinguishing a light source by an LD control unit according to the present embodiment.

FIG. 11 is a timing chart for explaining an example of control of lighting and extinguishing a light source by the LD control unit according to the present embodiment.

The LD control unit 21F1 shown in FIG. 4 outputs an LD drive signal for controlling the LD 31 shown in FIG. 4 based on an image signal. Lighting and extinguishing of the LD 31 is controlled based on the LD drive signal. That is, the light beam emitted from the LD 31, which is explained with reference to FIG. 3, is a light controlled by the LD control unit 21F1.

A period of time that the LD 31 shown in FIG. 4 emits light is controlled based on a duty ratio of a pulse signal of the LD drive signal. That is, the LD 31 shown in FIG. 4 is controlled according to a so-called "pulse width modulation control" (hereinafter, referred to as PWM control). According to the control of lighting and extinguishing of the LD 31 based on the duty ratio, the LD control unit 21F1 shown in FIG. 4 controls a density of an image.

The LD control unit 21F1 shown in FIG. 4, generates the LD drive signal based on a value of the image signal which is input. The LD drive signal generates a pulse signal for the image signal.

Meanwhile, a pulse width of the LD drive signal 21F1 can be determined by a user of the image forming apparatus 100 using a pulse width adjustment signal. Moreover, the LD drive signal is not limited to the PWM signal.

Moreover, the LD control unit 21F1 shown in FIG. 4 lights the LD 31 shown in FIG. 4 based on the synchronization detection forced lighting signal BD.

A period of time that the LD 31 shown in FIG. 4 emits light is controlled based on a time width of pulse of the LD drive signal, as shown in FIG. 11.

The LD drive signal is a pulse signal having a predetermined time width corresponding to a value of an image signal which is input, as shown in FIG. 11.

FIG. 11 exemplifies a case where the image signal has a two bit width, i.e. any one of values 0, 1, 2 and 3, for example. The duty ratio of the LD drive signal is, for example, in the case where the value of the image signal is 3, 100% as shown by a pulse width W1. Similarly, in the case where the value of the image signal is 2, the duty ratio of the LD drive signal is 66% as shown by a pulse width W2. In the case where the value of the image signal is 1, the duty ratio of the LD drive signal is 33% as shown by a pulse width W3.

In the case where the value of the image signal is 0, the image signal indicates extinguishment of the LD. In the case where the value of the image signal is 0, the LD drive signal may generate the LD drive signal having a time width which is less than a delay of emission, as shown by a pulse width W4.

Even in the case where the value of the image signal is 0, by generating the LD drive signal having a time width less than the delay of emission, responsiveness of a light source can be enhanced in the subsequent lighting of the light source. For example, in the case where image signals having values of zero continue, as shown by a timing T5 in FIG. 11, even if the LD drive signals are generated with short pulse widths successively, the light source is not lighted, and thereby an occurrence of scumming can be prevented.

Moreover, in the case where the image signals having values of zero continues, a control signal just before an image signal, a value of which becomes greater than or equal to one, preferably generates an LD drive signal having a time width less than the delay of emission.

Meanwhile, the bit width of the image signal is not limited to two bits. For example the bit width of the image signal may be one bit, i.e. the image signal may have two values, 0 or 1. Moreover, the bit width of the image signal may be three bits or more.

Meanwhile, the duty ratio of the LD drive signal is not limited to 100%, 66% or 33%. For example, the duty ratio of the LD drive signal for each image signal may be set by a pulse width adjustment signal which is input from the printer control unit 100F5 shown in FIG. 4.

<Sub Scanning Control Signal in the Case of Forming Color Image>

Figure 12:
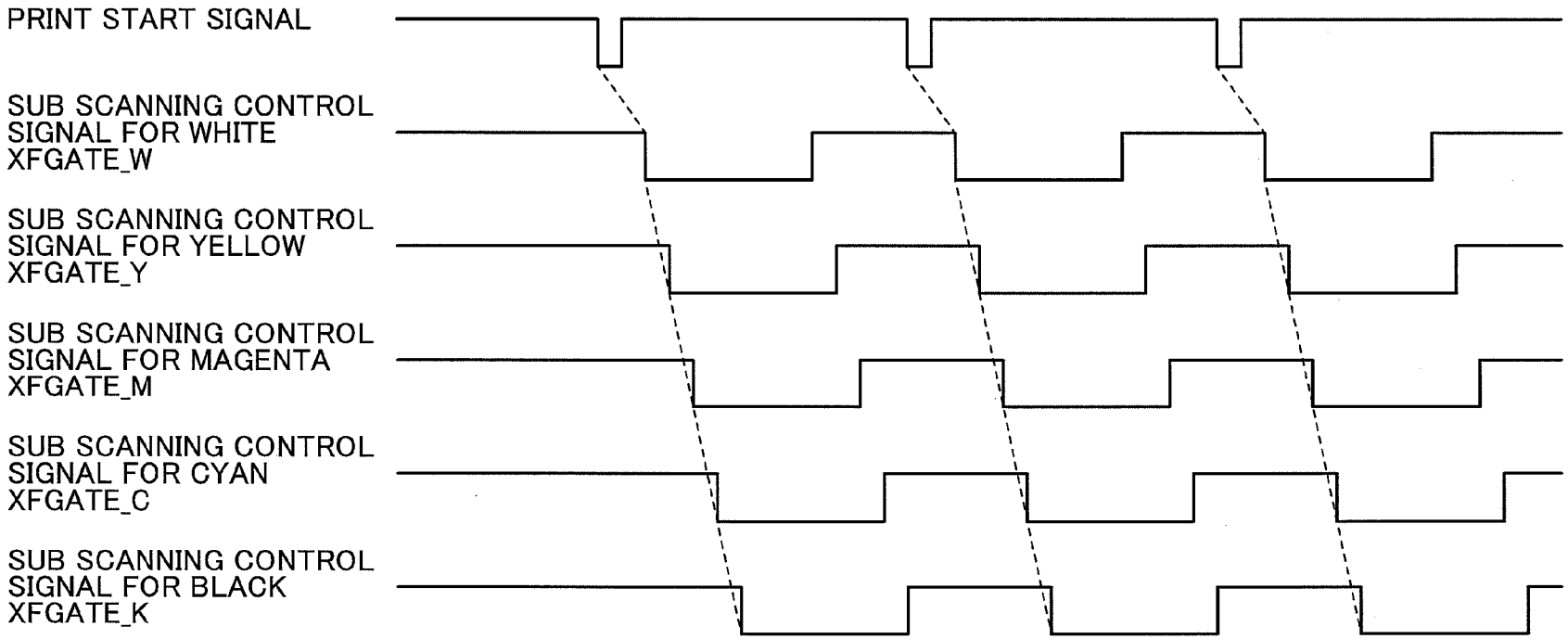
FIG. 12 is a timing chart for explaining an example of a timing of a sub scanning control signal in the case of forming a color image in five colors according to the present embodiment.

FIG. 12 is a timing chart for explaining an example of a timing of a sub scanning control signal in the case of forming a color image in five colors according to the present embodiment.

The image forming apparatus 100 includes the sub scanning control signal XFGATE, which is explained with reference to FIG. 9 and the like, for each color. In the case where the number of colors is five, i.e. white (W), yellow (Y), magenta (M), cyan (C) and black (K), the image forming apparatus 100 includes five sub scanning control signals XFGATE. The sub scanning control signals for white, yellow, magenta, cyan and black are denoted XFGATE_W, XFGATE_Y, XFGATE_M, XFGATE_C and XFGATE_K, respectively.

A control signal for a first color is, for example, the sub scanning control signal for black XFGATE_K. A control signal for a second color is, for example, the sub scanning control signal for white XFGATE_W, the sub scanning control signal for yellow XFGATE_Y, the sub scanning control signal for magenta XFGATE_M, and the sub scanning control signal for cyan XFGATE_C. In the following, the case where the control signal for the first color is the sub scanning control signal for black XFGATE_K and the control signal for the second color is the sub scanning control signal for a color other than black XFGATE will be explained as an example.

Output of the sub scanning control signal for each of the colors starts, as shown in FIG. 12, using the print start signal as a trigger. The sub scanning control signals for the respective colors are output while the timings are shifted with each other based on the locations of the photoconductor units 40 shown in FIG. 2.

The image forming apparatus 100 forms electrostatic latent images on the surfaces of the photoconductor units 40 shown in FIG. 2 for the respective colors based on the sub scanning control signals of the respective colors, and forms a toner image by overlaying toners of five colors on the intermediate transfer belt 10 shown in FIG. 2 based on the electrostatic latent images. The toner image is transferred onto a recording medium by the secondary transfer unit 22 shown in FIG. 2. Upon the secondary transfer unit 22 shown in FIG. 2 performing the transfer, a timing for conveying the recording medium, in order to transfer the toner image at a predetermined position on the recording medium, is determined based on the sub scanning control signals. The timing for conveying the recording medium is determined, for example, based on the sub scanning control signal for black XFGATE_K.

A conveyance means is, for example, the registration roller 49 shown in FIG. 1. In the following, the registration roller 49 shown in FIG. 1 will be explained as an example. The timing for conveying a recording medium is, for example, a timing for conveying the recording medium from the registration roller 49 shown in FIG. 1. That is, the recording medium is conveyed by the registration roller 49 shown in FIG. 1 based on the sub scanning control signal for black XFGATE_K, and the transfer is performed at a predetermined position on the recording medium.

<Sub Scanning Control Signal in the Case of Forming Monochrome Image>

Figure 13:
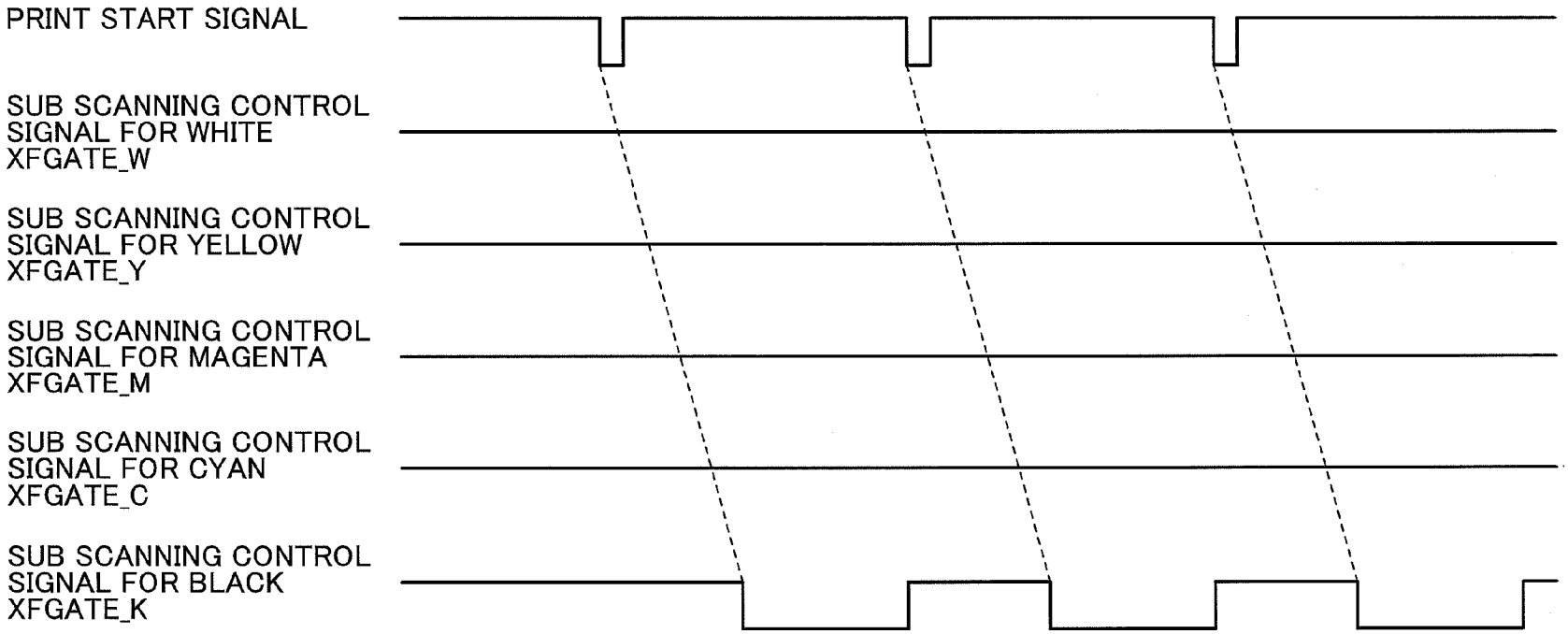
FIG. 13 is a timing chart for explaining an example of a timing of the sub scanning control signal in the case of forming a monochromatic image according to the present embodiment.

FIG. 13 is a timing chart for explaining an example of a timing of the sub scanning control signal in the case of forming a monochromatic image according to the present embodiment.

Formation of a monochrome image is an image formation using only black. Accordingly, for unused colors other than black, since an image formation is not performed, the sub scanning control signals may not be generated, as shown in FIG. 13.

The sub scanning control signal for black XFGATE_K is the same as that shown in FIG. 12. The timing for conveying a recording medium is determined, for example, based on the sub scanning control signal for black XFGATE_K, in the same way as in FIG. 12.

<Sub Scanning Control Signal in the Case of Forming Image by White>

Figure 14:
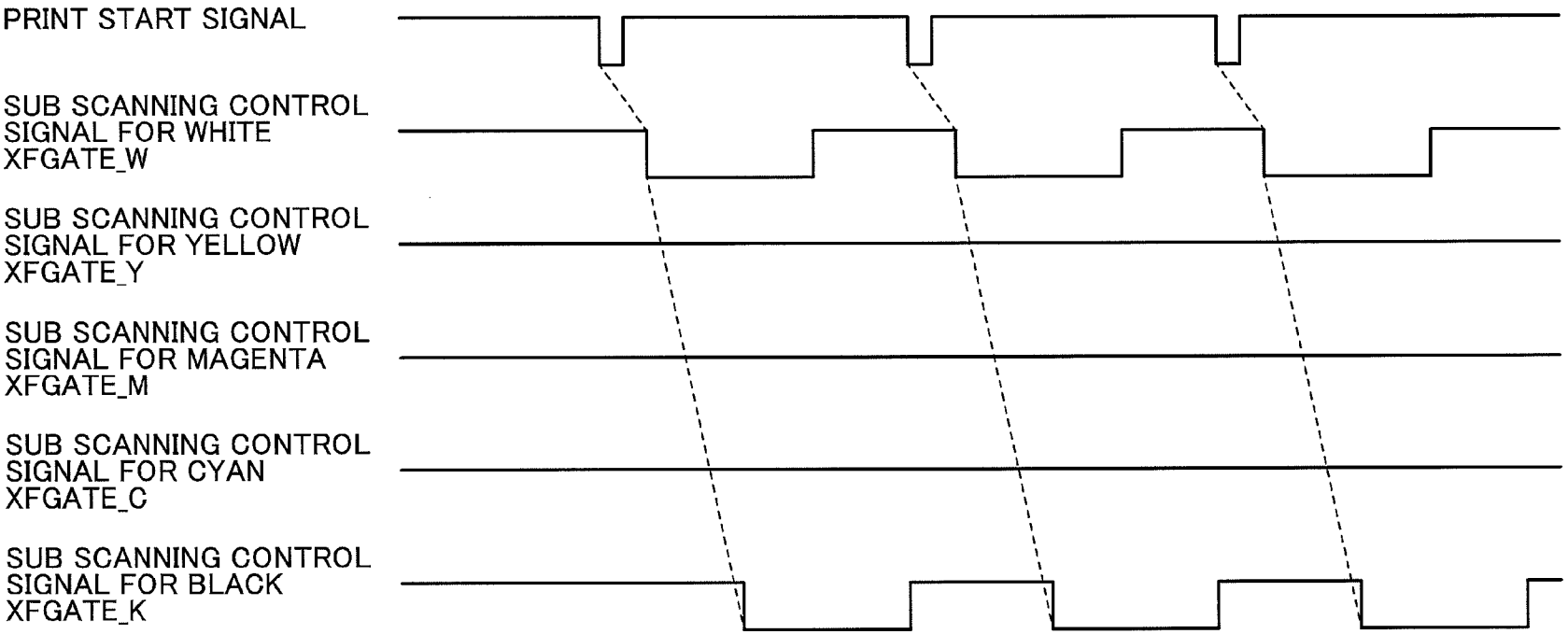
FIG. 14 is a timing chart for explaining an example of a timing of the sub scanning control signal in the case of forming a white image according to the present embodiment.

FIG. 14 is a timing chart for explaining an example of a timing of the sub scanning control signal in the case of forming a white image according to the present embodiment.

Formation of a white image is an image formation using white. Formation of an image using a single color is, for example, an image formation using white. In the following, the image formation using white will be explained as an example.

In the case of the formation of a white image, the image forming apparatus 100 generates the sub scanning control signal for black XFGATE_K. Timings in the sub scanning control signal for black XFGATE_K are the same as those shown in FIGS. 12 and 13. The sub scanning control signal for black XFGATE_K is used for determining a timing for conveying the recording medium.

In the case of the formation of a white image, an electric current applied to the LD 31 for black shown in FIG. 4 may be less than the electric current upon the image formation. The electric current applied to the LD 31 shown in FIG. 4 upon the image formation is a so-called "bias electric current" in order to enhance a light-emission characteristic of the light source. In the case of the formation of a white image, the electric current applied to the LD 31 for black shown in FIG. 4 upon scanning the photoconductor unit 40 is less than the bias electric current. For example, in the case where the bias electric current is 10 mA for forming a white image, the electric current applied to the LD 31 for black shown in FIG. 4 upon scanning the photoconductor unit 40 is 0 to 5 mA, for example. That is, the LD 31 for black shown in FIG. 4 does not emit light when the electric current is less than the bias electric current, and an electrostatic latent image for black is not formed.

Meanwhile, the bias electric current and the electric current applied to the LD 31 for black shown in FIG. 4 are not limited to the above-described electric current values. The respective electric current values may be set corresponding to characteristic of the light source. The bias electric current and the electric current applied to the LD 31 for black shown in FIG. 4 are preferably electric current values so as not to light the light source in order to prevent degradation of the photoconductor.

In the case of the formation of a white image, the electric current applied to the LD 31 for black shown in FIG. 4, upon detecting the synchronization detection signal XDETP, is a current to the extent of lighting the light source.

The formation of a white image is the case where an image formation for black is not performed. In the case of the formation of a white image, the image forming apparatus 100 makes the electric current applied to the LD 31 for black shown in FIG. 4, upon scanning the photoconductor unit 40 shown in FIG. 2, less than the bias electric current. Since the bias electric current is an electric current applied upon standing by for lighting the light source, when it is less than the bias electric current, the light source is difficult to be lighted. By making it less than the bias electric current, the image forming apparatus 100 can prevent the LD 31 for black shown in FIG. 4 from lighting. The image forming apparatus 100 can reduce degradation of the photoconductor unit 40 shown in FIG. 2 by preventing the light source of the LD 31 for black shown in FIG. 4 from lighting.

Meanwhile, the color is not limited to white. The formation of a white image may be applied to the case where a color other than white is used.

The case of forming a color image, the case of forming a monochrome image and the case of forming an image by white are so-called "modes". That is, even in every mode, a timing for conveying a recording medium is determined based on the sub scanning control signal for black XFGATE_K. Even in every mode, the image forming apparatus 100 generates the sub scanning control signal for black XFGATE_K in order to determine the timing for conveying a recording medium. The sub scanning control signal for black XFGATE_K is generated regardless of whether data related to a black image are input.

Since the sub scanning control signal for black XFGATE_K is generated in any mode, the timing for conveying a recording medium can be determined based on the sub scanning control signal for black XFGATE_K in any mode. Accordingly, since the timing for conveying a recording medium is based on the sub scanning control signal for black XFGATE_K in any mode, the timing for conveying a recording medium can be made the same in any mode. Accordingly, the image forming apparatus 100 can form an image at the same position on a recording medium by any mode.

For example, in the case where a white image is formed and the sub scanning control signal XFGATE_K is not generated, the timing for conveying a recording medium is required to be performed by a sub scanning control signal for white XFGATE_W. As explained with reference to FIG. 12, the sub scanning control signal for black XFGATE_K and the sub scanning control signal for white XFGATE_W are shifted from each other. Therefore, the timing for conveying a recording medium determined based on the sub scanning control signal for white XFGATE_W is required to be adjusted taking account of an amount of the shift. By generating the sub scanning control signal for black XFGATE_K, even in the case of forming a white image, the image forming apparatus 100 can determine the timing for conveying at the same timing without the adjustment or the like.

The timing for conveying a recording medium in the case of using the sub scanning control signal for black XFGATE_K is preferable. Black is a color used for forming a monochrome image, a color image or the like. That is, black is a color used more often compared with the other colors. Accordingly, the sub scanning control signal for black XFGATE_K is often generated in order to be used for an image formation. Thus, the sub scanning control signal for black XFGATE_K is less often generated only in order to determine the timing for conveying compared with the other colors. Accordingly, the image forming apparatus 100, using the sub scanning control signal for black XFGATE_K for the timing for conveying a recording medium, can reduce generation of sub scanning control signal for a color, an image of which is not formed. Moreover, the image forming apparatus 100, by using the sub scanning control signal for black XFGATE_K for the timing for conveying a recording medium, can reduce degradation of the light source of a color, an image of which is not formed. The image forming apparatus 100, by reducing the use of the light source of a color, an image of which is not formed, can reduce degradation of the photoconductor unit of the color, an image of which is not formed.

Meanwhile, the modes are not limited to three modes explained as above with reference to FIGS. 12 to 15. In the present embodiment, the sub scanning control signal for black XFGATE_K may be generated in an other mode, for example.

<Whole Processing>

Figure 15:
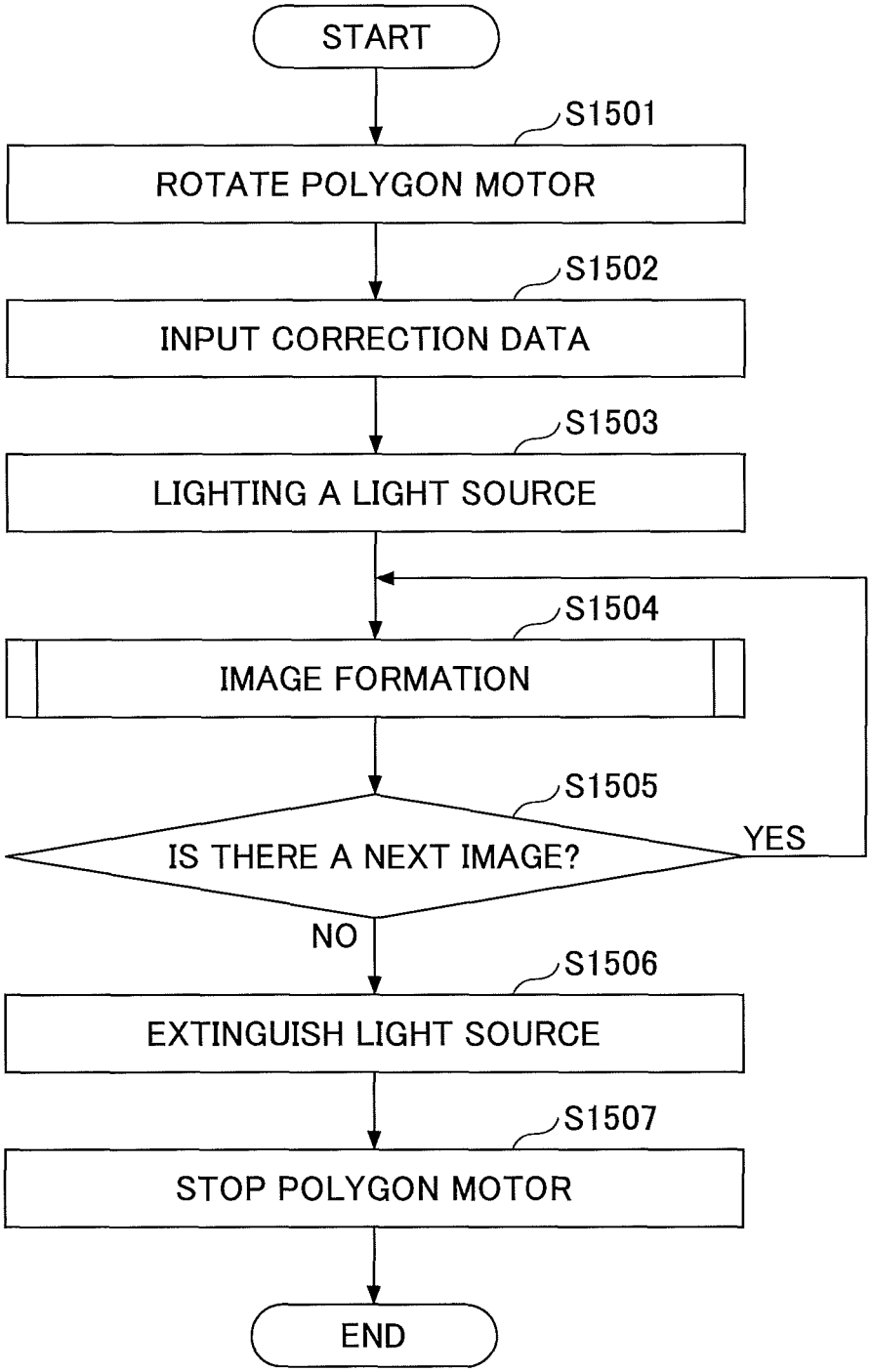
FIG. 15 is a flowchart for explaining an example of whole processing according to the present embodiment.

FIG. 15 is a flowchart for explaining an example of whole processing according to the present embodiment.

At first, the image forming apparatus 100 causes the polygon motor (not shown), which rotates the polygon mirror 11 shown in FIG. 3, to rotate at a rotational speed instructed by the printer control unit 100F5 shown in FIG. 4 (step S1501). The process at step S1501 is the case where a start operation is performed using an operation panel (not shown) included in the operation unit 100F6 shown in FIG. 4.

Then, the image forming apparatus 100 causes the printer control unit 100F5 shown in FIG. 4 to input correction data (step S1502). That is, the image forming apparatus 100 causes a user to input using the operation panel included in the operation unit 100F6 shown in FIG. 4 or the like. The correction data are, for example, setting values or the like sent by a setting signal shown in FIG. 7.

The image forming apparatus 100 performs a process for lighting a light source for the LD control unit 21F1 shown in FIG. 4 (step S1503). The process for lighting a light source includes a process for lighting in order to output the synchronization detection forced lighting signal BD, a so-called "APC operation" in order to light each light source at a predetermined light amount or the like.

The image forming apparatus 100 performs an image formation (step S1504). The image formation performs an image formation on a recording medium according to a control or the like of the light source by the LD control unit 21F1 shown in FIG. 4 based on image data input to the image forming apparatus 100.

The image forming apparatus 100 determines whether there is a next image (step S1505). The image forming apparatus 100 upon determining that there is a next image (step S1505: YES), returns to step S1504, and performs an image formation for the next image. The image forming apparatus 100 upon determining that there is not a next image (step S1505: NO), proceeds to step S1506.

Next, the image forming apparatus 100 extinguishes the light source (step S1506).

Then, the image forming apparatus 100 stops the polygon motor (not shown) that rotates the polygon mirror 11 shown in FIG. 3 (step S1507), and ends the whole processing.

Further, the present invention is not limited to these embodiments, but various variations and modifications may be made without departing from the scope of the present invention.

What is claimed is:

1. An image forming apparatus for forming an image on a recording medium comprising:

a first photoconductor on which a first intermediate image of a first color is formed;

a second photoconductor on which a second intermediate image of a second color is formed, the second color being different from the first color;

a first light source configured to emit light to the first photoconductor;

a second light source configured to emit light to the second photoconductor;

a light source control unit configured to control the first light source to emit light according to a light emission control signal;

a conveyance control signal generation unit configured to generate a conveyance control signal based on a timing of emitting light by the first light source according to the light emission control signal; and a conveyance unit configured to convey the recording medium at a timing determined based on the conveyance control signal in order to transfer the second intermediate image onto the recording medium, wherein the light source control unit is configured to control the first light source not to emit light to the first photoconductor but to generate the conveyance control signal by applying an electric current less than a threshold to the first light source if forming an image not including the first color.

2. The image forming apparatus as claimed in claim 1 wherein the first color is black.

3. The image forming apparatus as claimed in claim 1 wherein the light emission control signal comprises a signal indicating a write start position and width.

4. The image forming apparatus as claimed in claim 1 wherein the conveyance unit conveys the recording medium based on the conveyance control signal, in a case of forming an image including a color other than yellow, magenta, cyan and black.

5. The image forming apparatus as claimed in claim 1 further comprising a synchronization detection unit configured to receive the light emitted from the first light source according to the light emission control signal and detect a timing of a writing start in a second direction orthogonal to a direction for conveying the recording medium, wherein the light source control unit controls the first light source to emit light by applying an electric current greater than or equal to the threshold to the first light source.

6. An image forming method for forming an image on a recording medium comprising:

controlling a first light source to emit light according to a light emission control signal, the first light source being configured to emit light to a first photoconductor on which a first intermediate image of a first color is formed;

generating a conveyance control signal based on a timing of emitting light by the first light source according to the light emission control signal; and conveying the recording medium at a timing determined based on the conveyance control signal in order to transfer a second intermediate image of a second color onto the recording medium, the second intermediate image being formed on a second photoconductor, and the second color being different from the first color, wherein controlling the first light source causes the first light source not to emit light to the first photoconductor but to generate the conveyance control signal by applying an electric current less than a threshold to the first light source if forming an image not including the first color.

* * * * *